US005516059A

United States Patent [19]

Gudgeon et al.

[11] Patent Number: 5,516,059

[45] Date of Patent: May 14, 1996

[54] ELECTRICAL WIRE SPOOL GUIDE

[76] Inventors: Thomas A. Gudgeon, 4072 Foothill Rd., Santa Barbara, Calif. 93110; John Trinity, 2447 Las Canoas, Santa Barbara, Calif. 93101

[21] Appl. No.: 344,490

[22] Filed: Nov. 23, 1994

[51] Int. Cl.[6] ..... B65H 49/06

[52] U.S. Cl. ..... 242/566; 242/578; 242/125.2; 242/129.5

[58] Field of Search ..... 242/118, 125, 242/125.1, 125.2, 125.3, 128, 129.5, 129.51, 129.53, 129.7, 129.72, 134, 156.1, 566, 578, 578.1, 578.2, 588, 588.3, 588.6, 599.1, 599.2, 599.3

[56] References Cited

U.S. PATENT DOCUMENTS

| | | | |
|---|---|---|---|
| 95,271 | 9/1869 | Schraeder . | |
| 1,387,300 | 9/1921 | Oliver et al. . | |
| 1,476,778 | 12/1923 | Tate . | |
| 2,665,858 | 1/1954 | Barlow | 242/125.2 |
| 2,908,132 | 10/1959 | Klemm | 242/566 |
| 3,106,366 | 10/1963 | Bernard, Jr. . | |
| 3,131,886 | 5/1964 | Scheuring | 242/129.53 |
| 3,593,936 | 7/1971 | Davis | 242/578 |
| 3,820,733 | 6/1974 | Roederer | 242/578 |
| 3,942,736 | 3/1976 | Ramos | 242/566 |
| 4,948,064 | 8/1990 | Richard | 242/129.5 |
| 5,181,449 | 1/1993 | Winandy | 242/588 |
| 5,267,705 | 12/1993 | Hofrichter et al. | 242/129 |

*Primary Examiner*—John P. Darling
*Attorney, Agent, or Firm*—W. D. English

[57] ABSTRACT

A wire guide to control and contain electrical wire as it is pulled off a standard spool that is rotating about a spindle. The guide has side plates that rest alongside the spool and rotate about the same spindle upon which the spool turns. An adjustable spacer extends between the side plates to insure a good fit for any width spool. Adjustable length guide bars also extend between the side plates with the wire passing between the guide bars so that wire is prevented from expanding radially outward and becoming entangled.

12 Claims, 2 Drawing Sheets

ELECTRICAL WIRE SPOOL GUIDE

TECHNICAL FIELD

This invention relates to the electrical wire arts, more specifically the dispensing of wire from spools, and still more specifically the guidance, control, and containment of such wire during dispensing.

BACKGROUND OF THE INVENTION

Electricians install wire in buildings by pulling different colored strands from standardized wire spools and running the collection of wires through various types of metal and plastic conduits. To make this operation more efficient, the wire spools are mounted on racks where they are free to rotate so as to allow the wire to easily unwind from the spools. Often, as the spools spin, the centrifugal force expands the wraps of wire radially outward to where they fall off the spool and become tangled with each other or the rack. Even after the electrician stops pulling the wire, the spool may continue to spin, under stored momentum, so that the wire billows out into a tangled mess. Thus, a lot of time is wasted keeping the runs of wire clear and free.

This problem is exacerbated when the electrician moves to different parts of the job and, therefore, pulls the wire from different directions. In this situation, wire may try to spiral off the end of the spool without even turning the spool, causing the wire to wrap around the spindle supporting the spool.

The prior art has attempted to deal with this kind of problem by supplying spool supports that have guides incorporated to control the path of the wire. Such devices are shown, for example, in U.S. Pat. Nos. 3,131,886 to Scheuring and 1,476,778 to Tate. However, these prior art approaches suffer from several problems. First, they hold or contain the spool in a fixed position with the wire path guide in a fixed location so that the wire must exit in a certain place and in a certain direction in order to work well. Second, since they are designed for a given size spool, they are not transferrable to many different size spools. Electrical wire comes on many different size spools, depending on the wire size, function, and manufacturer. An electrician never knows in advance the exact shape and size spool he will be pulling wire from. It would be much superior if he had a wire control device that could control any size and shape spool.

Still another problem with the prior art is complexity and cost. A wire guide should be simple and inexpensive, even though it is adjustable to work with any size spool and in any direction of wire pulling. Otherwise, the guide may cause the electrician more trouble than assistance. The present invention meets these requirements.

STATEMENT OF THE INVENTION

Briefly, this invention provides a wire guide that does not connect to the wire spool, but rather rotates about the wire rack spindle that supports the spool of wire. Because of this, the guide easily turns to follow the electrician's direction of pull. And yet, a wire path is maintained between a pair of guide bars that insures that the wire unrolls from the spool in the correct tangential direction, rather than spiraling off the end of the spool. The guide has a pair of side plates, one on each side of the spool, that are spaced from each other by an adjustable length spacer so as to fit snugly adjacent to any size spool that the electrician may encounter. The pair of guide bars also extend between the side plates and are also adjustable in length so as to work with any width spool. A minimum of parts and complexity insures ease of use and low cost. The adjustable spacer is secured at a given width by a simple set screw or by using threaded telescoping tubes, in alternative embodiments. The guide bars may be fixed, or may roll for even lower resistance to the passage of wire therebetween. Other details, advantages, and benefits will become apparent from the following detailed description and the drawings referenced thereby.

DETAILED DESCRIPTION OF THE INVENTION

Figure 1:
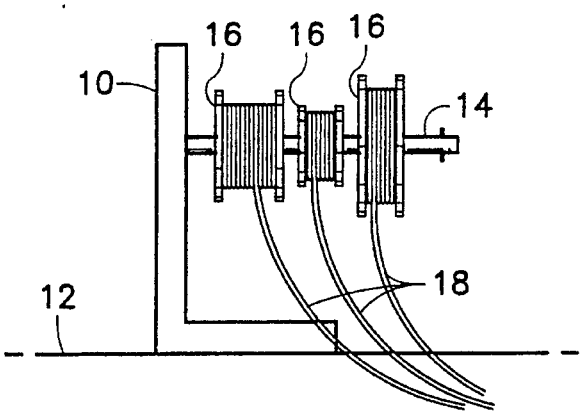
FIG. 1 (PRIOR ART)
FIG. 1 is a simplified view of an electric wire rack.

Referring to FIG. 1, electricians use a wire rack 10 that typically rests on the floor 12, and includes one or more spindles 14 upon which a plurality of spools of wire 16 are rotatably carried. Although spools 16 come in a large variety of sizes and widths, they usually share a common diameter hole in the center so as to fit properly over spindle 14. The wire tails 18 are pulled from the spools in a bundle and threaded through conduit to construct electrical circuits.

As the wire is pulled from the spools, the spools are caused to rotate or spin so as to unreel the wire. This spin generally continues, even after the pulling ceases. The spin generates a centrifugal force that urges the wire remaining on the spool radially outward. Since the spool is still spinning, the unwinding wire is free to expand outward and leave the spool. The wires tangle with themselves, or with each other, or wrap around the spindle causing endless irritating interruptions in order to free the entangled wire. The present inventive wire guide, which is shown in FIGS. 2 and 3, eliminates these problems.

Figure 2:
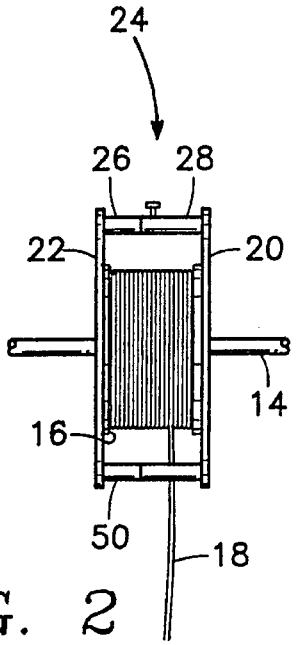
FIG. 2 is an elevational view of the wire guide of the present invention showing how the guide is rotatably supported on the same spindle that supports the spools of wire and also showing how the guide fits closely around the spool so as to contain the wire on the spool.
Figure 3:
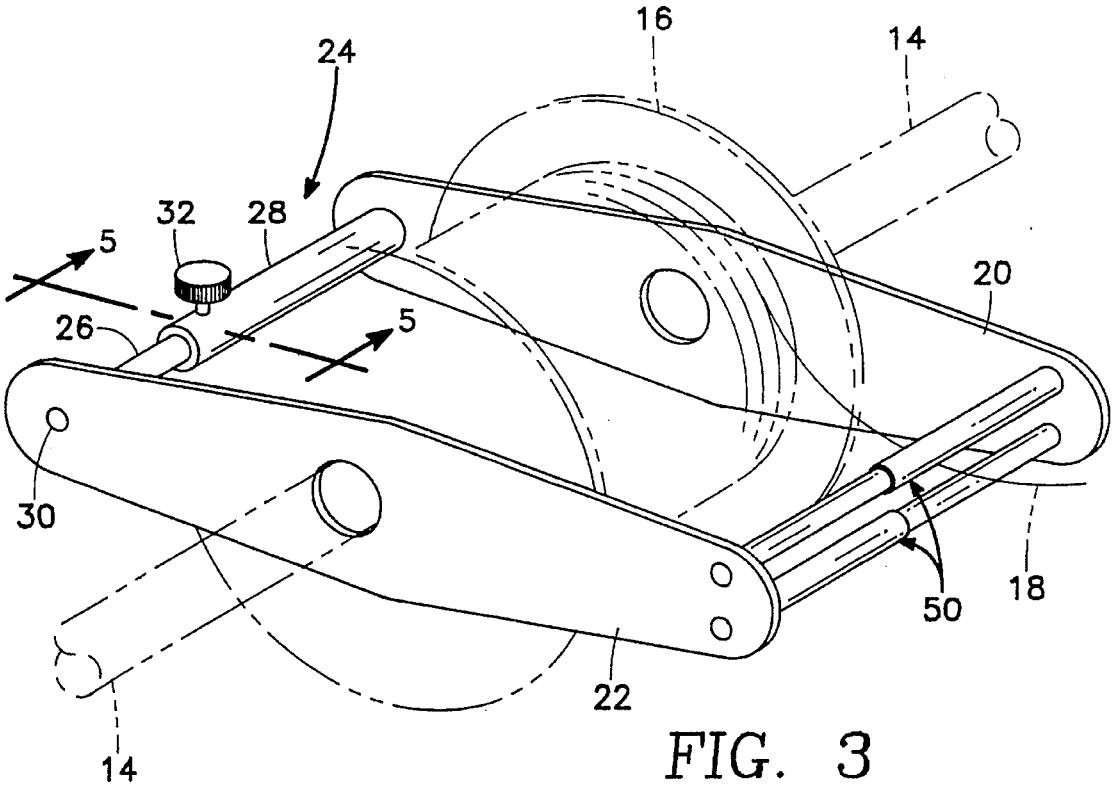
FIG. 3 is a perspective view of the wire guide of FIG. 2.

In FIGS. 2 and 3 it may be seen that the wire guide comprises a pair of side plates 20 and 22 with holes near the center that allow plates 20 and 22 to slide onto, and rotate about, the spindle 14. The electrician simply places a spool of wire between the side plates, aligns the holes, and slides the guide and spool assembly onto spindle 14. At least one adjustable length spacing means 24 extends between the side plates so as to hold the side plates immediately adjacent the sides of spool 16. In FIGS. 2 and 3, spacer 24 comprises a cylindrical member 26, fastened to side plate 22, that telescopes into a larger tubular member 28 that is fastened to side plate 20, in this case, by a screw 30. When the side plates 20 and 22 are positioned closely adjacent to the spool 16, spacer 24 is fixed in length with a thumb or set screw 32 that is threaded through member 28 and against member 26.

Figure 5:
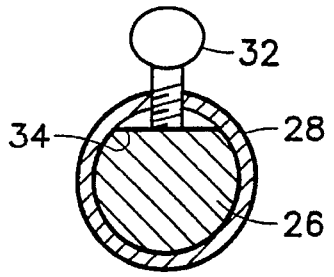
FIG. 5 is a section of the adjustable spacer showing the locking thumb screw arrangement.

The cross sectional view of FIG. 5 shows how screw 32 passes through member 28 and bears against the member 26 that is telescoped inside tubular member 28. To avoid creating burrs on member 26, under repeated use, which burrs could interfere with the smooth telescoping action, it is desirable to have screw 32 bear against a flat area 34, as shown in FIG. 5.

Figure 6:
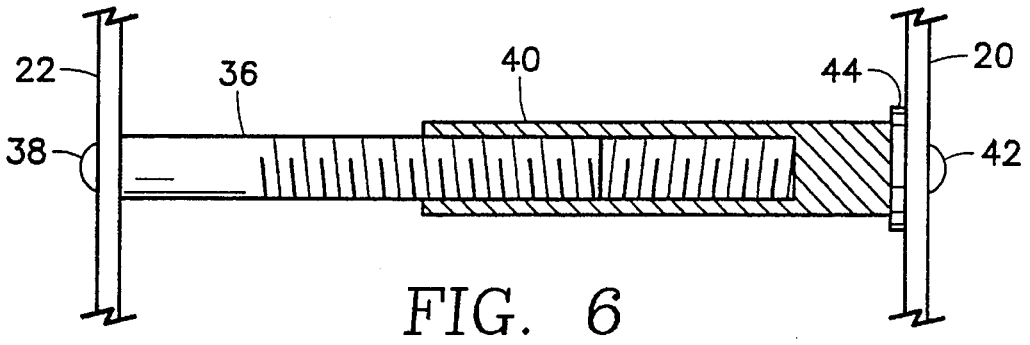
FIG. 6 shows an alternative embodiment of the width spacer.

Another possible embodiment of the adjustable width spacer 24 is shown in FIG. 6. A threaded member 36 is attached to side plate 22 with a screw 38. An internally threaded tube 40 is secured to side plate 20 with a screw 42. The size of screw 42 is chosen so as to bottom out in tube 40 just before pulling tube 40 too tightly against plate 20. Thus, tube 40 may be rotated so as to advance along threaded member 36 and adjust the length of the spacer as desired. A Teflon washer 44 provides a low friction bearing to permit easier rotation of spacer tube 40. Other embodiments of an adjustable length spacer 24 are, of course, possible. But the threaded telescopic tubes and the thumb screw locked telescopic tubes have been found to work very well.

Returning to FIGS. 2 and 3, a pair of guide bars 50 are shown extending between the side plates at the opposite end of the side plates from the spacer 24. The wire 18 passes between guide bars 50. The combination of bars 50 and the side plates defines a path for the wire that always remains in line with the spool, keeps the wire moving off the spool tangentially, and prevents the wire from pulling sideways off the spool. Since the wire guide is not fixed, but can rotate about the spindle 14, guide bars 50 can move to follow the direction of pull, even if the electrician moves to the opposite side of rack 10. If a spinning spool starts the wire billowing outward, the wire soon rubs against spacer 24 and guide bars 50 halting the radially outward expansion. It should be noted that, in the drawing, the guide bars 50 and spacer 24 are shown somewhat farther away from the spool than would be the case in the actual device, so as to make the drawing clearer, especially in FIGS. 3 and 4. FIG. 2 is more typical of the preferred embodiment. The spacer 24 and guide bars 50 are positioned close to the peripheral edge of spool 16 so as to closely contain any billowing wire. Even if several turns of wire billow out from the spool, they are captured inside the side plates, guide bars, and spacer so that they can not fall off the spool and become entangled.

Figure 4:
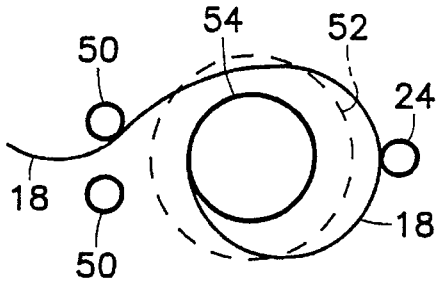
FIG. 4 is a schematic diagram showing the geometric relationship of the wire spool, the guide bars, and the adjustable spacer and how any radial billowing of the wire off the spool is not only contained and restrained, but operates to brake the rotation of the spool so as to prevent any further billowing.

FIG. 4 diagrams how the wire guide controls the radial expansion of wire. The peripheral edge of the spool is represented by circular dashed line 52. The roll of wire itself is shown as a circle 54. Other circles represent guide bars 50 and spacer 24. As shown in FIG. 4, if wire 18 billows radially outward, it rubs against spacer 24 and bars 50 and thereby frictionally stops the spinning spool sooner. Also, as the wire billows, it is forced to traverse an ever tighter turn in passing between bars 50 which also generates a braking effect. Thus, the unwanted continued spinning of spool 16 is prevented. The billowed wire turns are contained and kept in good order. An additional advantage is that when the job is done, and the wire is rolled back onto the spool, guide bars 50 insure that the wire rolls easily and tangentially back onto the roll 54.

Figure 7:
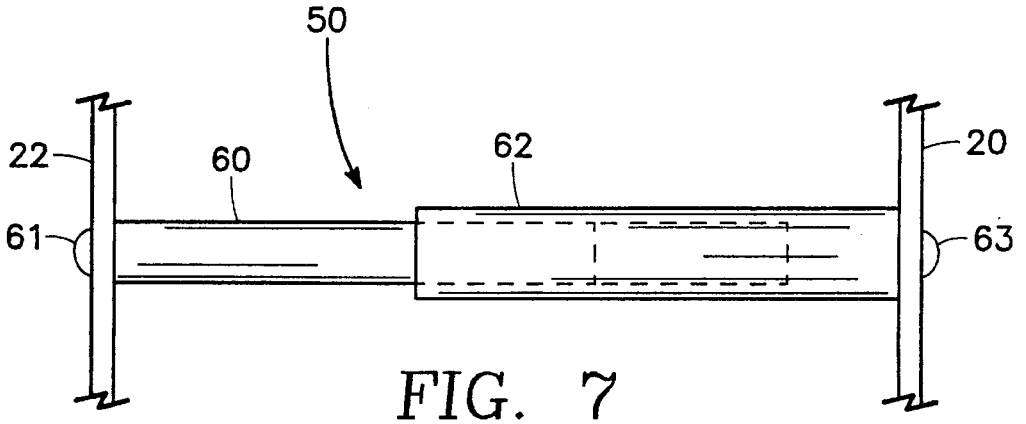
FIG. 7 shows a low cost embodiment of the guide bars that maintain a path for the wire.
Figure 8:
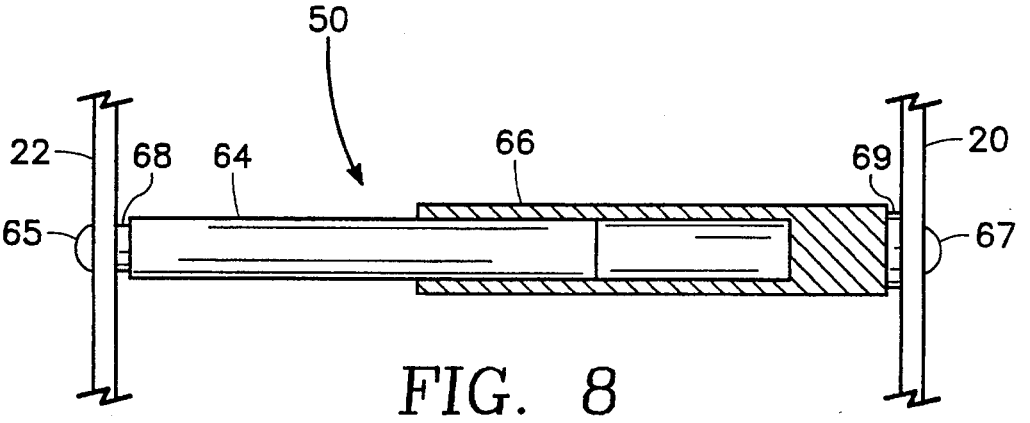
FIG. 8 shows a slightly more complicated but lower friction embodiment of the guide bars in which the guide bars can roll as well.

Guide bars 50 also telescope to the width between the side plates determined by spacer 24. FIG. 7 shows a simple telescopic guide bar 50 that has a cylindrical member 60, affixed to side plate 22 with a screw 61, that slides into a tubular member 62 affixed to side plate 20 with a screw 63. For lower friction, the guide bars may be made to roll, as in FIG. 8. Here the cylindrical member 64 is rotatably mounted to plate 22 with a screw 65 and a Teflon washer 68. A tubular member 66 is rotatably mounted to plate 20 with a screw 67 and a washer 69. Screws 65 and 67 are sized to bottom out in their respective members before pulling them too tightly to rotate. In FIG. 8, the guide bar 50 not only telescopes to the correct distance between the side plates, but also revolves to assist the passage of the wire thereacross.

In the preferred embodiment, the various parts of the wire guide are constructed from aircraft grade aluminum for high strength and light weight. However, other metals and plastics could be used. The side plates are somewhat diamond shaped, but could be of any shape, even shapes that are everywhere wider than the spool diameter. The wire guide of the invention is applicable to any wire or cable such as shielded metal wire and fiber optic cable. Many modifications may be made to the disclosed structure without departing from the spirit and scope of the invention and, thus, the invention should only be limited in accordance with the appended claims and their equivalents.

We claim:

1. A wire guide for controlling and containing the unwinding of electrical wire from a spool of wire on a spindle comprising in combination:

a pair of side plates adapted to be rotatable on the same spindle upon which the wire spool revolves, said plates further adapted to rest adjacent the sides of the spool with one plate on each side;

an adjustable length spacing means extending from one side plate to the other so as to be operable to locate the plates adjacent the sides of the spool for any width of spool; and a pair of adjustable length guide bars, also extending from one side plate to another so as to be operable to define a path between the guide bars for the wire unrolling from the spool, said guide bars and said side plates operating together to contain and restrain wire from billowing off of the spool for any direction of pulling of the wire.

2. The wire guide of claim 1 in which said spacing means comprises telescoping members operable to be locked together at the desired length by a screw threaded through one member into contact with the other member.

3. The wire guide of claim 2 in which said other member has a flat area at the point of contact by said screw.

4. The wire guide of claim 1 in which said spacing means comprises a first rotatable member connected to one side plate and also threadably connected to a second member connected to the other side plate so that rotation of the rotatable member relative to the second member causes advancement along the threads and a change in the length of said spacing means.

5. The wire guide of claim 1 in which said guide bars comprise a pair of telescopic members affixed to the side plates so as to telescope to the distance between the side plates established by said spacing means.

6. The wire guide of claim 5 in which said telescopic members are affixed to the side plates in a manner so as to be rotatable so as to allow lower friction passage of wire therebetween.

7. The wire guide of claim 6 in which said spacing means comprises telescoping members operable to be locked together at the desired length by a screw threaded through one member into contact with the other member.

8. The wire guide of claim 7 in which said other member has a flat area at the point of contact by said screw.

9. The wire guide of claim 6 in which said spacing means comprises a first rotatable member connected to one side plate and also threadably connected to a second member connected to the other side plate so that rotation of the rotatable member relative to the second member causes advancement along the threads and a change in the length of said spacing means.

10. The wire guide of claim 5 in which said spacing means comprises telescoping members operable to be locked together at the desired length by a screw threaded through one member into contact with the other member.

11. The wire guide of claim 10 in which said other member has a flat area at the point of contact by said screw.

12. The wire guide of claim 5 in which said spacing means comprises a first rotatable member connected to one side plate and also threadably connected to a second member connected to the other side plate so that rotation of the rotatable member relative to the second member causes advancement along the threads and a change in the length of said spacing means.

* * * * *